US006642657B2

(12) United States Patent
Mako et al.

(10) Patent No.: US 6,642,657 B2
(45) Date of Patent: Nov. 4, 2003

(54) ROBUST PIERCE GUN HAVING MULTIPLE TRANSMITTING AND EMITTING SECTION

(75) Inventors: Frederick M. Mako, 6308 Young Branch Dr., Fairfax Station, VA (US) 22039; Amnon Fisher, Alexandria, VA (US)

(73) Assignees: Frederick M. Mako, Fairfax Station, VA (US); Ansel M. Schwartz, Pittsburgh, PA (US)

( * ) Notice: Subject to any disclaimer, the term of this patent is extended or adjusted under 35 U.S.C. 154(b) by 0 days.

(21) Appl. No.: 09/992,694

(22) Filed: Nov. 20, 2001

(65) Prior Publication Data

US 2002/0125841 A1 Sep. 12, 2002

Related U.S. Application Data

(63) Continuation of application No. 08/651,627, filed on May 22, 1996, now abandoned, which is a continuation-in-part of application No. 08/348,040, filed on Dec. 1, 1994, now abandoned.

(51) Int. Cl.[7] ..... H01J 23/06

(52) U.S. Cl. ..... 315/5.11; 315/5.12; 315/5.33; 315/5.34; 315/5.31; 313/103 R; 313/104

(58) Field of Search ..... 315/4.5, 5.11, 315/5.12, 5.33, 5.34, 5.35, 5.37; 313/103 R, 104; 331/79; 327/301

(56) References Cited

U.S. PATENT DOCUMENTS

| | | | | |
|---|---|---|---|---|
| 2,276,758 A | * | 3/1942 | Brueche et al. | 313/104 X |
| 2,294,782 A | * | 9/1942 | Jacobsen | 313/103 R X |
| 2,408,423 A | * | 10/1946 | Hartley | 315/5.11 |
| 3,505,612 A | * | 4/1970 | Hergenrother | 315/5 X |
| 5,150,067 A | * | 9/1992 | McMillan | 315/5.11 X |

* cited by examiner

*Primary Examiner*—Benny T. Lee
(74) *Attorney, Agent, or Firm*—Ansel M. Schwartz

(57) ABSTRACT

An electron gun that generate an electron flow and the application of this gun to produce rf energy or for injectors. The electron gun includes an electrostatic cavity having a first stage with emitting faces and multiple stages with emitting sections. The gun also includes a mechanism for producing an electrostatic force which encompasses the emitting faces and the multiple emitting sections so electrons are directed from the emitting faces toward the emitting sections to contact the emitting sections and generate additional electrons and to further contact other emitting sections to generate additional electrons and so on then finally to escape the end of the cavity. A method for producing a flow of electrons.

8 Claims, 5 Drawing Sheets

Plots of secondary emission ratio (yield) versus primary electron energy in: 1 reflection mode of operation and 2 transmission mode of operation.

Plots of secondary yield from CVD diamond: 1 without added CsI deposition and 2 with 10 nm of CsI deposited.

Electron deposition profile in diamond as calculated by the Monte Carlo computer code CEPXS/ONEDAT for a 5 keV electron beam.

ROBUST PIERCE GUN HAVING MULTIPLE TRANSMITTING AND EMITTING SECTION

This is a continuation of U.S. patent application Ser. No. 08/651,627 filed May 22, 1996, abandoned, which is a continuation-in-part of U.S. patent application Ser. No. 08/348,040 filed Dec. 1, 1994, abandoned.

FIELD OF THE INVENTION

The present invention is related to electron guns. More specifically, the present invention is related to an electron gun that uses an electrostatic field to radially focus and axially accelerate a DC electron beam.

BACKGROUND OF THE INVENTION

The development of reliable, non-contaminating and long-life (robust) high-current electron beam sources for injection into klystrons and related devices has been a challenging problem for many years. High-current beams are widely used in injector systems for electron accelerators, both for industrial linear accelerators (linacs) and high-energy accelerators. High-current electron beams are also used for microwave generation (in klystrons and related devices), for research on advanced methods of particle acceleration, and for injectors used for free-electron laser (FEL) drivers. During the last few years considerable effort has been applied to the development of high power linac injectors [J. L. Adamski et al., IEEE Trans. Nucl. Sci. NS-32, 3397 (1985); T. F. Godlove, et al, Part. Accel. 34, 169 (1990)] and particularly to laser-initiated photocathode injectors [J. S. Fraser and R. L. Sheffield, IEEE J. Quantum Elec. QE-23, 1489 (1987); P. Schoessow, E. Chojnacki, W. Gai, C. Ho, R. Konecny, S. Mtingwa, J. Norem, M. Rosing, and J. Simpson, Proc. of the 2nd Euro. Part. Accel. Conf. p. 606 (1990)]. The best of the laser injectors have relatively high beam quality, but their reliability depends on the choice of photocathode material, with the more reliable materials requiring intense laser illumination.

The high-density electron gun invention to be described here is called a *Robust Pierce Gun* (RPG). [See "Theory and Design of Electron Beams", J. R. Pierce, D. Van Nostrand Company, Inc. (1954)]. The RPG avoids the difficulties associated with plasma cathodes, thermionic emitters, and field emission cathodes. Plasma cathodes cannot be operated at high repetition rate, nor can they sustain very long pulses without voltage collapse. Thermionic emitters are only good for low current densities (<20 Amps/cm$^2$), and are easily contaminated. Field emission cathodes require a huge field (~$10^9$ MV/m) for reasonable emission. Laser-initiated photocathodes require an expensive laser system and suffer from reliability issues in high electric fields.

High current-density beam generation methods used to date are rather complex, cumbersome, expensive, and have very definite limits on performance. The RPG described here is promising in large part because of the natural current amplification process inherent in secondary electron emission. This natural amplification process makes possible a simply-designed gun which could provide a cold cathode at high-current densities operating at modest duty factors and relatively high-quality pulsed electron beams suitable for many applications.

SUMMARY OF THE INVENTION

The present invention relies upon amplifying, by means of secondary electron emission, a beam of electrons produced by a reliable low-current-density electron emitter. The invention is based on the phenomenon of transmitted secondary electron production from surfaces of negative-electron-affinity (NEA) materials [R. U. Martinelli and D. G. Fisher, Proc. of the IEEE 62, 1339 (1974); H. Bruining, Physics and Applications of Secondary Electron Emission (Pergamon Press, London, 1954), incorporated by reference herein]. A beam of electrons (primary beam) is accelerated in a cathode/anode configuration to impinge on a film electrode (which has a thickness to allow the transmission mode of operation) of an NEA material. Depending on the range of the electrons in the film electrode, secondary electrons are then created preferentially on the backside of the thin film electrode, that is, in the direction of propagation of the primary beam. Current amplification through one stage of a NEA material like diamond could be increased by a factor of 50. To accomplish amplification of the electron current density, one or more stages of secondary emitter films are utilized along with one primary emitter. The primary emitter is a low-current-density robust emitter (e.g., thoriated tungsten). Examples of NEA materials are GaAs, GaP, Si, diamond, and materials used as photoemitters, secondary electron emitters, and cold-cathode emitters.

The first component of the present invention pertains to the electron gun. The electron gun comprises an electrostatic cavity having a first stage with emitting faces and multiple stages with emitting sections. The gun is also comprised of a mechanism for producing an electrostatic force which encompasses the emitting faces and the multiple emitting sections so electrons are directed from the emitting faces toward the emitting sections to contact the emitting sections and generate additional electrons and to further contact other emitting sections to generate additional electrons and so on, then finally to escape the end of the cavity.

The emitting sections preferably provide the cavity with an accelerating force for electrons inside the cavity. The multiple sections preferably include forward emitting surfaces. The forward emitting surfaces can be of an annular shape, or of a circular shape, or of a rhombohedron shape.

The mechanism preferably includes a mechanism for producing an electrostatic electric field that provides the force and which has a radial component that prevents the electrons from straying out of the region between the first stage with emitting faces and the multiple emitting sections. Additionally, the gun includes a mechanism for producing a magnetic field to contain the electrons anywhere from the first stage with emitting faces or any emitting section and to the end of the cavity.

The first component of the present invention pertains to a method for producing a flow of electrons. The method comprises the steps of moving at least a first electron in a first direction at one location. Next there is the step of striking a first area with the first electron. Then there is the step of producing additional electrons at the first area due to the first electron. Next there is the step of moving electrons from the first area to a second area and transmitting electrons through the second area and creating more electrons due to electrons from the first area striking the second area. These newly created electrons from the second area move in the first direction then strike the third area, fourth area, etc. Each area creates even more electrons in a repeating manner by the electrons moving in the first direction to multiple areas. This process is also repeated at different locations.

The mechanism preferably includes a mechanism for accelerating the electrons inside the cavity to allow the electron multiplication to continue.

The electron preferably includes a control grid for interrupting the flow of electrons and thus to create bunching of the electrons.

The present invention pertains to an electron gun. The electron gun comprises an electrostatic cavity having a first stage with electron emitting faces and multiple stages with electron emitting sections. The electron gun also comprises a mechanism for producing an electrostatic force which encompasses the electron emitting faces and the multiple electron emitting sections so electrons from the electron emitting faces and sections are directed from the emitting faces toward the emitting sections to contact the emitting sections and generate additional electrons on the opposite sides of the emitting sections and to further contact other emitting sections.

The present invention pertains to a method for producing electrons. The method comprises the steps of moving at least a first electron in a first direction from a first location. Then, there is the step of striking a first area with the first electron. Next, there is the step of producing additional electrons at the first area due to the first electrons on the opposite side of the first area which was struck by the first electron. Next, there is the step of moving electrons from the first area to a second area. Then, there is the step of transmitting electrons to the second area and creating more electrons due to electrons from the first area striking the second area.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 8:
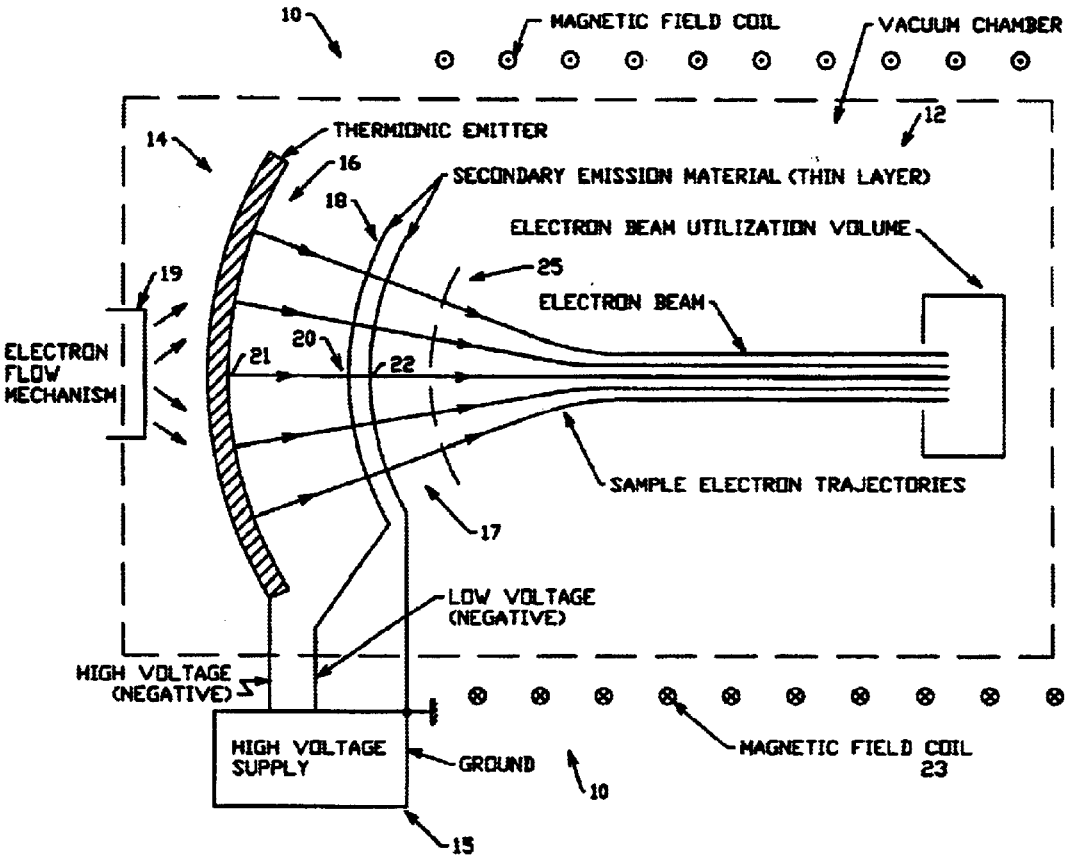
FIG. 8. Schematic representation of the robust Pierce gun.

Referring now to the drawings wherein like reference numerals refer to similar or identical parts throughout the several views, and more specifically to FIG. 8 thereof, there is shown an electron gun 10. The electron gun 10 comprises an electrostatic cavity 12 having a first stage 14 with electron emitting faces 16 and multiple stages with electron emitting sections 18. The electron gun 10 also comprises a mechanism 15 for producing an electrostatic force which encompasses the electron emitting faces 16 and the multiple electron emitting sections 18 so electrons from the electron emitting faces 16 and sections 18 are directed from the emitting faces 16 toward the emitting sections 18 to contact the emitting sections 18 and generate additional electrons on the opposite sides of the emitting sections 18 and to further contact other emitting sections 18.

The emitting sections 18 preferably provide the cavity 12 with an accelerating force for electrons inside the cavity 12. The multiple sections 18 preferably include forward emitting surfaces. Preferably, the forward emitting surfaces are of an annular shape. Alternatively, the forward emitting services can be of a circular or a rhombohedron shape. Preferably, the emitting sections 18 provide the cavity 12 with a force to accelerate electrons to a higher energy.

The mechanism 15 for producing an electrostatic force preferably includes a mechanism 17 for producing an electrostatic electric field that provides the force and which has a radial component that prevents the electrons from straying out of the region between the first stage 14 with emitting faces 16 and the multiple emitting sections 18. The electrostatic force producing mechanism 15 preferably includes a mechanism 19 for producing a flow of electrons from a first stage 14 with emitting faces 16 or any emitting section 18 and to the end of the cavity 12. The producing mechanism 15 preferably includes a mechanism 23 for producing a magnetic field to confine the electrons to contain the electrons anywhere from the first stage 14 with emitting faces 16 or any emitting section and the end of the cavity 12. Preferably, the gun 10 includes a grid 25 for bunching electrons. The gun 10 can be used, for instance, for RF sources of energy and for injectors.

The present invention pertains to a method for producing electrons. The method comprises the steps of moving at least a first electron in a first direction from a first location 21. Then, there is the step of striking a first area 20 with the first electron. Next, there is the step of producing additional electrons at the first area 20 due to the first electrons on the opposite side of the first area 20 which was struck by the first electron. Next, there is the step of moving electrons from the first area 20 to a second area 22. Then, there is the step of transmitting electrons to the second area 22 and creating more electrons due to electrons from the first area 20 striking the second area 22.

Figure 1:
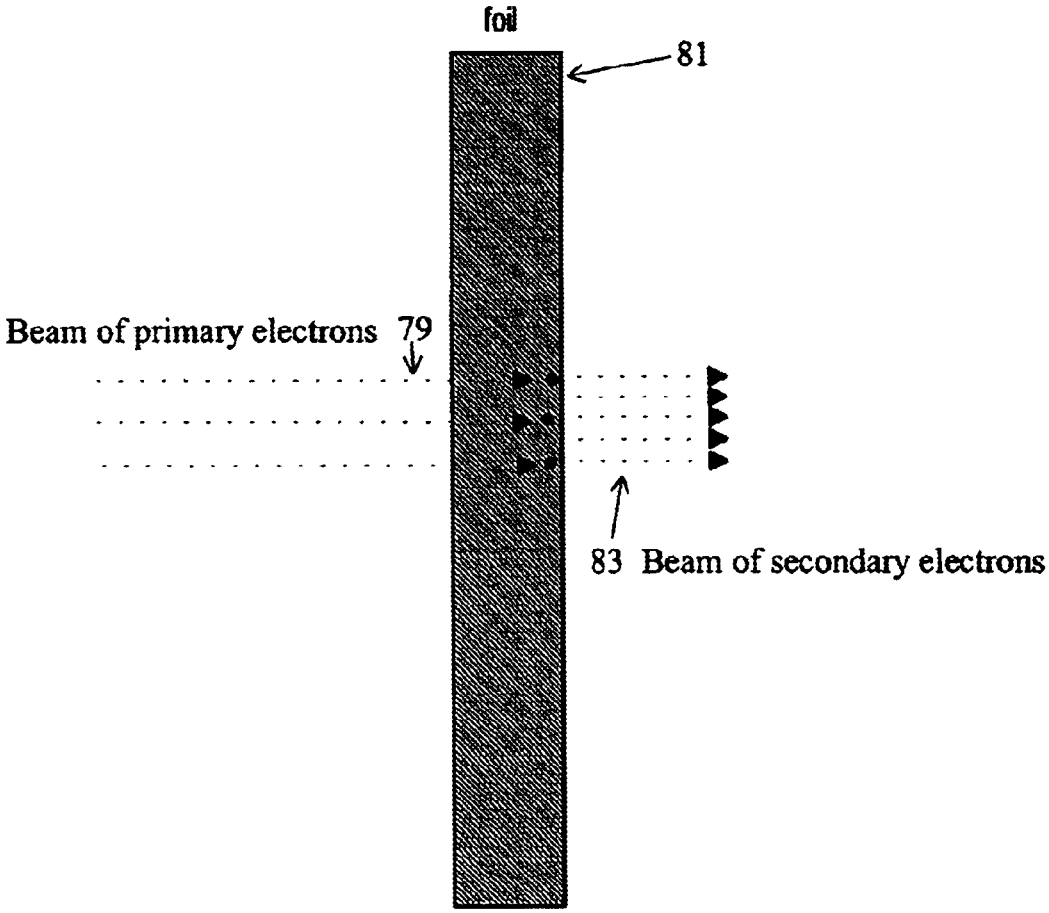
FIG. 1. Schematic drawing of the current multiplication process.
Figure 2:
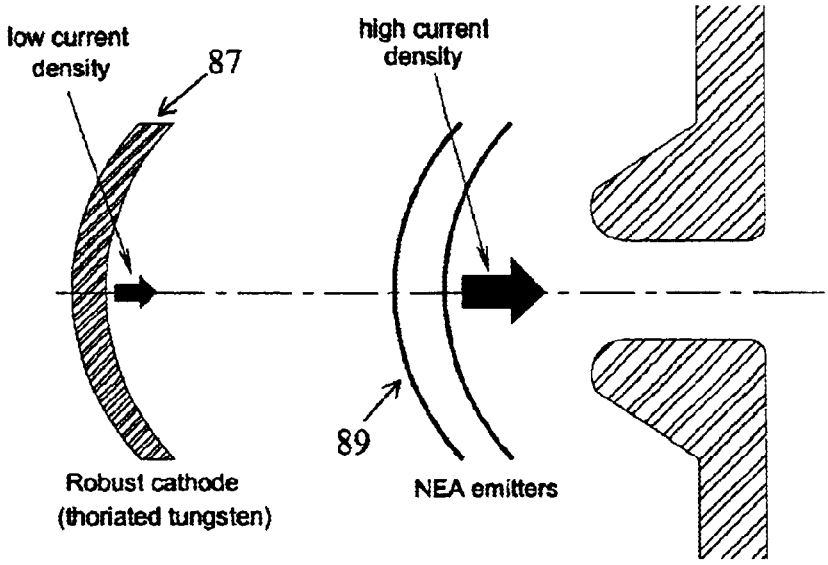
FIG. 2. Schematic drawing of a two-stage robust Pierce gun (RPG).

The RPG invention employs the emission of secondary electrons in a transmission mode as opposed to the conventional mode of reflection, i.e., electrons exit from the back face of a negative electron affinity (NEA) material, and in the same direction as the incident beam. FIG. 1 shows the basic idea of a primary electron beam 79 being deposited into a foil 81 or film of a secondary emitter and the emergence of a secondary beam 83 in the same direction as the primary beam. FIG. 2 shows the overall idea where electron current amplification is accomplished in two stages of secondary emitters. The primary emitter is a low current density robust emitter 87 (e.g., thoriated tungsten). The secondary emitters are NEA electrodes 89 which emit secondary electrons in the same direction as the incident beam. Specific application is targeted for klystron guns in the current density range of up to several tens of amps/cm$^2$, pulse lengths in the multi-microseconds, and repetition rates up to several hundred pulses/second.

Figure 3:
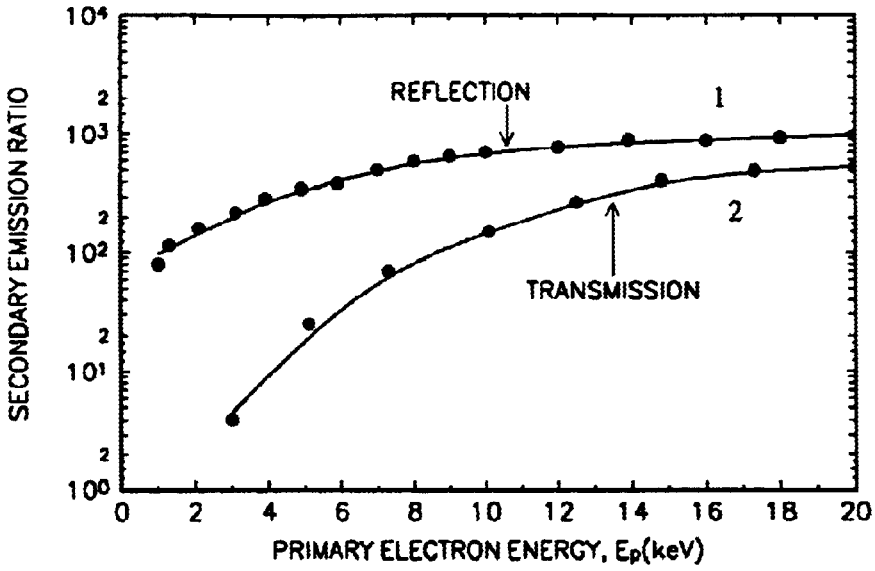
FIG. 3. Illustration of transmission and reflection modes of secondary electron emission.

FIG. 3 illustrates the transmission and reflection secondary emission properties of an NEA material, in particular cesiated silicon. The secondary electron emission yield in the transmission mode for this particular NEA material is very large. For example, the secondary emission coefficient for the transmitted electron current (i.e., the secondaries which leave the back surface of the material and travel away from the cathode) is 100 (for primary electron energies of 10 keV) to 1000 (for energies of 20 keV). The yield for the reflected electron current (i.e., the usual case in which secondaries are emitted off the front surface of the material and travel back towards the primary cathode) is 1000 for energies 10–20 keV. However, because cesiated silicon is sensitive to contamination, a better material is cesiated diamond as the secondary emitter. The NEA electrode materials of choice are chemical vapor deposited (CVD) diamond films. This new technology has shown great promise in developing high yield robust secondary emission materials.

A negative electron affinity surface is a material for which the difference between the bulk conduction band minimum and the Fermi level is greater than the work function. If this condition holds, an electron with energy greater than or equal to the conduction band minimum energy encounters no work function barrier at the semiconductor surface. To achieve this condition, the work function of a semiconductor is reduced by the adsorption of electropositive elements (and sometimes by a combination of electropositive and electronegative elements) to atomically clean surfaces of the material. Cesium (Cs) and Oxygen (O) are the most popular adsorbates used. Common NEA materials are made from GaAs (Cs and Cs—O used as adsorbates), Si (Cs—O and Rb—O used as adsorbates), and similar types of materials. A summary of some known NEA surfaces with the corresponding adsorbates is given in Table I.

TABLE I

| Material | Adsorbate |
|---|---|
| GaAs | Cs, Cs-O, Cs-F |
| GaP | Cs |
| (In, Ga) As | Cs-O |
| InP | Cs-O |
| GaSb | Cs-O |
| Si | Cs-O, Rb-O |
| AlAs | Cs-O |
| Diamond | CsI (KCl, NaCl) |

Most of these materials are not robust, or not appropriate for use as an amplification stage. Chemical vapor deposited (CVD) films of diamond exhibit a stable NEA condition with high secondary electron emission (yields up to ~50 at an energy of 3 keV). These results were done for primary dc current densities up to 50 mA/cm$^2$, and the targets were coated with CsI from 10 to 100 nm thick. The emission was activated by electron beam-induced iodine depletion after short beam exposures. The resulting diamond surface is Cs terminated, and independent of the initial CsI thickness; it exhibits stability in air and back to vacuum again [G. T. Mearini, I. L. Krainsky, J. A. Dayton, Jr., Y. Wang, C. A. Zorman, J. C. Angus, R. W. Hoffman, D. F. Anderson, Appl. Phys. Lett. 66, 242 (1995), incorporated by reference herein].

Figure 4:
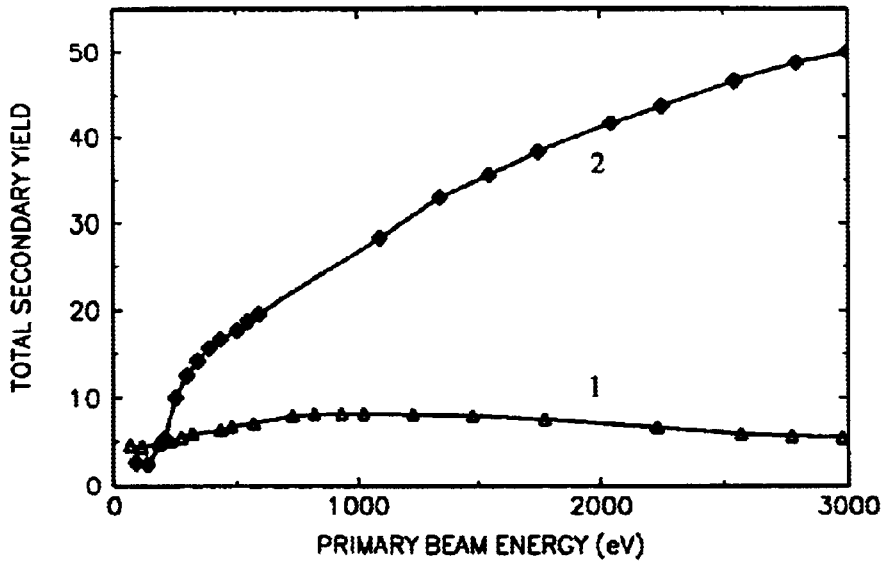
FIG. 4. Secondary electron coefficient vs. primary electron energy for CVD diamond in the reflection mode.

FIG. 4 shows the secondary electron yield vs. primary energy for CVD diamond in the reflection mode. The lower curve (described by the open triangles) is for uncoated diamond. The upper curve is for CVD diamond with a 10 nm thick CsI surface layer which converts the surface into an NEA emitter.

The range of the primary electrons in the NEA material must be slightly less than the material thickness. Otherwise, the bulk of the beam energy will be deposited near the front surface of the electrode. Secondary electrons will then be preferentially produced at this forward surface with a velocity back towards the cathode (i.e., conventional secondary electron emission). If the range of the primary electrons is too large, the primary electrons could traverse the layer completely. Either case will reduce the secondary emission yield of the device. In addition, the primary electrons that make it through the NEA surface will have a higher average transverse velocity than the secondaries (which are emitted primarily in the forward direction). The optimum range for the primaries is a distance a little less than a secondary electron diffusion length.

Optimally, the thickness of the NEA amplification material should be equal to an electron diffusion length. The diffusion length of an NEA emitter is equal to the escape depth, and is determined by the peak in the secondary electron emission yield curve. For electron energies larger than the peak, some secondaries born deep into the material will not have enough energy to escape. For electron energies smaller than the peak, the maximum amount of secondaries will not be produced. It is only at the peak in the yield that the range of the primary electrons is equal to an electron diffusion length in the material. The thickness of the NEA material should be a little larger than an electron diffusion length.

An electron diffusion length L is well known to be taken to be $$L=(\mu kT\tau/e)^{1/2}$$

where T is the temperature, k is the Boltzmann constant, $\mu$ is the electron mobility, e is the electron charge, and $\tau$ is the electron lifetime. In general, the diffusion length L is dependent on the doping concentration, the growth method, and other factors. Optimal NEA material thicknesses are 3–10 $\mu$m for Si, 3 to 5 $\mu$m for GaAs, and 0.2 $\mu$m for GaP.

The diffusion length L is essentially the distance over which a secondary electron born in the bulk of the material can travel before recombining across the band gap. In contrast, the escape depth is the depth in the material from which a secondary electron can diffuse to the surface of the material and escape. When a secondary electron is born in the bulk of the material and begins to migrate toward the material surface, it loses energy to the lattice through collisions at a rate of about 50 meV per collision with mean free paths between collisions of 25 to 50 angstroms. Typically, a secondary electron produced in the material travels only a few hundred angstroms before its energy decays to the bottom of the conduction band, at which point it is in thermal equilibrium with the lattice. Such a so-called thermalized minority electron can survive for a relatively long time before recombining. However, if there is a potential barrier at the material surface then such an electron does not have sufficient energy to escape into the vacuum. In a conventional emitter or a non-NEA emitter just such a potential barrier exists so that unless the secondary electron is born within a few hundred angstroms of the surface, it will not have sufficient energy to escape. This is why the escape depth in a conventional emitter is only of the order of a few hundred angstroms, a distance from one order to several orders of magnitude smaller than the diffusion length of the secondary electrons in the material. The great advantage of NEA emitters is that this potential barrier is removed by treating the material surface so that the escape depth for secondary electrons in an NEA material is equal to the diffusion length, a distance of the order of microns.

The lower curve in FIG. 4 shows the secondary electron emission curve in the reflection mode for uncoated diamond film which is a conventional emitter with an escape depth of a few hundred angstroms. At lower energies the secondary yield rises because the number of generated secondary electrons increases with increasing primary energy and because at lower energies all of the primary electrons are stopped within a few hundred angstroms of the surface so that all of the secondary electrons produced can reach the surface with sufficient energy to escape. For incident energies greater than 1 keV the primary electrons penetrate the material to a depth greater than a few hundred angstroms so that not all of the secondary electrons produced can now escape and the secondary yield curve reaches a maximum and begins to fall off with incident energy. In contrast, the upper curve in FIG. 4 for the CsI-coated diamond, which is a NEA emitter, continues to rise with incident energy suggesting an escape depth comparable to the diffusion length for electrons in the material. The diffusion length can be estimated from the secondary yield for CsI-coated diamond in FIG. 4. By using the universal yield curve [B. K. Agarwal, Proc. Roy. Soc. 71, 851 (1958)].

$$\delta = \frac{\delta_{\max}(2\varepsilon/\varepsilon_{\max})}{[1+(\varepsilon/\varepsilon_{\max})^{1.85(2Z/A)}]}$$

the maximum of the secondary yield curve is approximately $\delta_{max}$=55 at a maximum primary energy of $e_{max}$=5 keV. Hence, the diffusion length is just the range in this material for 5 keV electrons which is calculated as follows.

Figure 5:
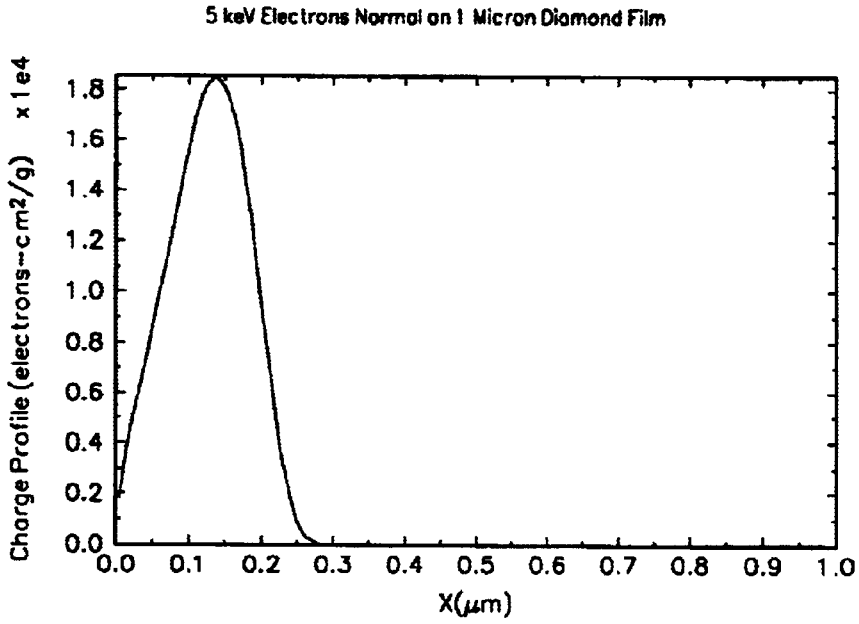
FIG. 5. Electron charge density profile as a function of position in diamond film.

FIG. 5 shows the charge deposition profile for 5 keV electrons normally incident from the left side on a one-micron thick layer of diamond film. It is evident that at these very low electron energies essentially all of the primary electrons are stopped within 0.3 micron of the incident surface. Because 5 keV corresponds to the peak in the secondary emission curve in FIG. 4, then from FIG. 5 the diffusion length is approximately 0.3$\mu\mu$. Hence, the thickness of the NEA material should be a little larger than 0.3 $\mu$m.

The ideal primary cathode should be chemically inert, and the rate of evaporation of the active material should be low. We have decided to employ thoriated tungsten for the primary cathode because of its robust properties. Its advantage over pure tungsten is the fact that it emits at lower temperatures (Table II). Operation at lower temperatures is important in issues such as reliability and long life. Thoriated tungsten is also much more robust and less susceptible to poisoning than competing cathodes such as $LaB_6$.

TABLE II

| T (° K.) | Tungsten (amps/cm$^2$) | Molybdenum (amps/cm$^2$) | Tantalum (amps/cm$^2$) | Thoriated Tungsten (amps/cm$^2$) |
|---|---|---|---|---|
| 1600 | $9.27 \times 10^{-7}$ | $2.39 \times 10^{-6}$ | $9.1 \times 10^{-6}$ | $4.06 \times 10^{-2}$ |
| 1800 | $4.47 \times 10^{-5}$ | $1.05 \times 10^{-4}$ | $3.32 \times 10^{-4}$ | 0.43 |
| 2000 | $1.00 \times 10^{-3}$ | $2.15 \times 10^{-3}$ | $6.21 \times 10^{-3}$ | 2.86 |
| 2400 | 0.12 | 0.22 | 0.51 | |
| 2600 | 0.72 | 1.29 | 2.25 | |
| 2800 | 3.54 | 6.04 | 12.53 | |

Energy deposition by the primary electron beam causes heating of the thin diamond films used as amplification stages. Also, radiation from the primary cathode of thoriated tungsten radiatively heats the amplification stages. The maximum yield of secondary emission for cesiated diamond is 55 at 5 keV. For two stages of amplification for the RPG, a primary beam from the thoriated-tungsten cathode at 0.0145 A/cm$^2$ will produce a secondary beam of 0.8 A/cm$^2$ at the first NEA electrode, which in turn will generate 44 $^2$A/cm at the second NEA electrode. The NEA diamond films are used in the transmission mode.

The peak power density on target is given by $$P=j_p(\mathrm{A/cm^2})\times E_p(\mathrm{eV})\mathrm{W/cm^2}$$

where $j_p$ and $E_p$ are the current density and energy of the primary electron beam respectively. For 5 keV primary electrons, the peak power density on target in the first diamond film is N73 W/cm$^2$ (for a 0.0145 A/cm$^2$ beam) and for the second stage is 4 kW/cm$^2$ (for a 0.8 A/cm$^2$ beam). The total beam energy deposited by a 2 $\mu$s pulse in the first and second stages are 0.145 mJ/cm$^2$ and 8 mJ/cm$^2$, respectively. Since diamond film is used as a secondary emitter in the transmission mode, its thickness is determined by the range of the 5 keV primary electrons. It is 0.3 mm, a thickness that poses no problem for the diamond film fabricators. The temperature rise in the film due to a single pulse can be calculated from $$mc_p\Delta T=Q$$

where m is the mass, $c_p$=0.42 J/g-° C. is the specific heat capacity of diamond, $\Delta T$ is the temperature rise and Q is the energy deposited. For the thickness used in this case, the deposited energy by one single pulse will raise the temperature of the diamond film by 3.6° C. in the first stage and 181° C. in the second stage.

Figure 6:
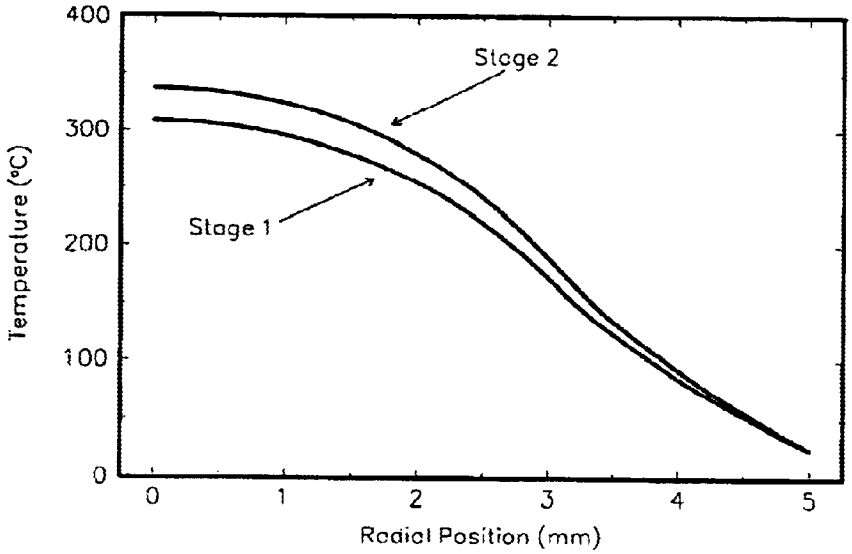
FIG. 6. The steady-state temperature distribution for the case of two stages of secondary emission after the primary cathode.

During operation, the diamond secondary cathode in the RPG is substantially hotter because of repetitive pulses and radiant heating from the thoriated-tungsten cathode. However, heat loss from the diamond films via radiation and conduction to the rest of the system will bring about an equilibrium temperature. For a 5 keV, 2 $\mu$s pulse at a repetition rate of 200 Hz and beam densities of 0.0145 A/cm$^2$ at the first stage and 0.8 A/cm$^2$ at the second stage, the steady state temperature is achieved in approximately 20 ms. For a 1 cm diameter diamond film with thickness 0.3 $\mu$m and with the beam heating the central region 6 mm in diameter. The first film is heated by the primary beam from the thoriated-tungsten as well as its black body radiation at ~1600° K with an emissivity of 0.1. It is assumed all the radiated heat is absorbed by the first diamond film. The second film is also heated by both beam and radiation energy, but in this case, the black body radiation is coming from the first diamond film. In this case the emissivity is 0.9. The only cooling is via radiation from the film faces and conduction to the edge of the disc, which is connected to the system and held at room temperature (25° C.). The steady-state temperature distributions in the diamond are as shown in FIG. 6. The hottest temperature, which is at the center of the second disc, is about 340° C. This is much lower than the graphitization temperature (~1200° C.) of diamond.

For the large area secondary emitter of the RPG, conduction is not as important as radiative losses. At equilibrium, the input power on target equals the power radiated from the two surfaces of the diamond.

$$P=2\epsilon_t\sigma T^4$$

where $\sigma$, the Stefan-Boltzmann constant is $5.67\times10^{-8}$ W m$^{-2}$ ° K$^{-4}$, T is the temperature on the surface and $\in_t$ is the emissivity. The factor of two takes into account the radiation losses on both sides of the diamond film. The time-average power deposited on the diamond is 1.89 W/cm$^2$ for the first stage, and 2.18 W/cm$^2$ for the second stage. For $\in_t$=0.9 (since the diamond film looks as dark as carbon), we get a temperature of 383° C. and 407° C. for the first and second stage. These temperatures do not present any problem to diamond.

The last emission stage operates at a much lower temperature than a conventional thermionic cathode. This fact allows a conventional control grid to be utilized without the conventional problems of thermal distortion and "self" emission. Thus, the electron beam flow can be switched on or off or bunched.

The actual current that can flow between two electrodes in a good vacuum is limited either by temperature saturation or space charge. The temperature-saturated current can be calculated from the well known expression for the electron emission per unit area for a heated cathode:

$$J=AT^2e^{b_0/T}$$

where J is the emission per unit area (in amps/cm$^2$) at T degrees (Kelvin). The quantities A and $b_0$ are constants. The current is also limited by space-charge effects since the space-charge depression near the cathode cannot be so large so as to cancel the applied electric field. The maximum current density in amps/cm$^2$ that can be drawn in a diode of spacing d cm at a voltage V (in volts) is given by the well known Child's law:

$$J = \frac{2.325\times10^{-6}}{d^2}V^{3/2}$$

The required gap spacing between the primary cathode and the 0.3 $\mu$m film of CsI-coated diamond NEA emitter can be determined from this equation by taking J=1 amps/cm$^2$ and V=5 keV. Hence, the gap spacing d is derived to be 9 mm for 1 amp/cm$^2$ and 6.3 mm for 2 amps/cm$^2$. For J=0.0145 amps/cm$^2$, d~7.5 cm, and for J=0.8 amps/cm$^2$, d~1 cm.

Note that the 5 kV is the voltage difference between stages, not the voltage to ground. With the thoriated tungsten cathode at −310 kV, the first NEA emitter will be at −305 kV, the second emitter will be at −300 kV and the anode at zero volts.

Both radial electric (Pierce shaping on the electrodes) and conventional pierce magnetic focussing are required in the RPG. The last NEA film cathode, accelerating tens of amperes to several hundred thousand volts, requires a magnetic field with this cathode being immersed or non-immersed in the magnetic field as needed by the application.

Figure 7:
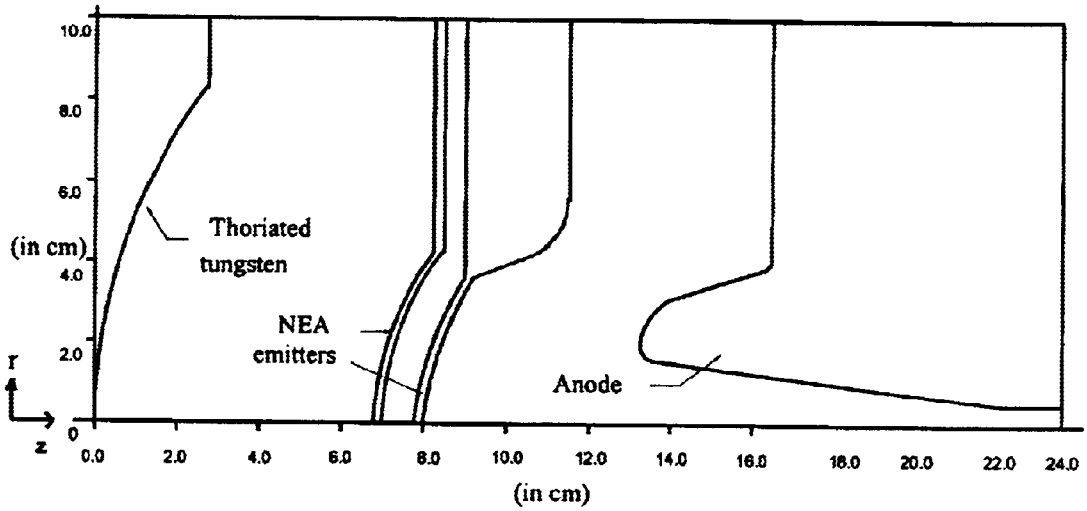
FIG. 7. Schematic cross-section drawing of a robust Pierce gun (RPG).

FIG. 7 shows a side view of a fabrication drawing for a RPG. This gun can operate up to 300 kV, about 40 A/cm$^2$, up to 2 msec long pulses and for repetition rates up to 200 pulses per second.

Fabrication of the diamond emitter can be accomplished by a number of methods. One of the simplest is to CVD coat 0.3 $\mu$m of diamond on either a thin molybdenum foil (10–50 mm thick) or silicon wafer (250–500 mm thick). Note that the silicon wafer or molybdenum foil are attractive surfaces for growing diamond. The molybdenum foil can then be ion beam or laser beam drilled down to the surface of the diamond film to form a mechanically supporting grid pattern of molybdenum. The silicon can be etched by standard masking and lithography techniques. The grid pattern forms a support for the diamond film, allows for electrons to pass through the holes of the support and provides a conduction path for charge. In order to have a reasonably high secondary production of >80% and provide support for the diamond film the following grid pattern shall be used. The grid will have a wire size of 0.1 mm thick and consist of 8 wires/cm of material. The CsI surface is activated by removal of the iodine by electron bombardment, leaving a Cs-terminated NEA surface. Thickness of the initial CsI will be about 10–100 nm. The thickness of the CsI coating is relatively unimportant, since after activation the Cs thickness is independent of initial thickness [G. T. Mearini, I. L. Krainsky, J. A. Dayton, Jr., Y. Wang, C. A. Zorman, J. C. Angus, R. W. Hoffman, D. F. Anderson, Appl. Phys. Lett. 66, 242 (1995), incorporated by reference herein].

FIG. 1. Schematic drawing of the current multiplication process. A low-current electron beam from a robust primary cathode is made to enter a material with a negative-electron-affinity (NEA) surface. The layer thickness is chosen so that the range of the primary electrons is less than the film thickness. The bulk of the primary beam energy is deposited in the negative electron affinity (NEA) material where the secondary electrons exit in the downstream direction.

FIG. 2. Schematic drawing of a two-stage robust Pierce gun (RPG). A low-current electron beam from a rugged and long-life cathode (−0.0145 Amp/cm$^2$) impinges on a negative electron affinity (NEA) surface. A high-current density beam is achieved by means of secondary electron emission (typically producing several tens of secondaries for each primary). There is a second amplification stage to further increase the current density to say 30–44 Amps/cm$^2$.

FIG. 3. Illustration of transmission and reflection modes of secondary electron emission. Secondary emission gain curve for a 2.5 micron thick Si dynode [R. U. Martinelli and D. G. Fisher, Proc. of the IEEE 62, 1339 (1974)]. Shown are data for reflected (top curve) and transmitted (bottom curve) secondary electrons. The described invention utilizes secondary electron emission in the transmission mode.

Table I. Summary of some known NBA materials with the corresponding adsorbates. In practice, the adsorbates are not denoted in the literature when referring to a particular material.

FIG. 4. Secondary electron coefficient vs. primary electron energy for CVD diamond in the reflection mode. The data represented by the filled-in spades (upper curve) represent CVD diamond after deposition of a 10 nm thick CsI surface layer. The open triangles (lower curve) represent that obtained from CVD diamond without an applied surface layer [G. T. Mearini, I. L. Krainsky, J. A. Dayton, Jr., Y. Wang, C. A. Zorman, J. C. Angus, R. W. Hoffman, D. F. Anderson, Appl. Phys. Lett. 66, 242 (1995)].

FIG. 5. Electron charge density profile as a function of position in diamond film. This result is for 5 keV electrons normally incident on a 1 $\mu$m thick diamond film. 5 keV primary electrons are optimum for the production of secondary electrons.

Table II. Emission characteristics of selected cathode materials as a function of temperature.

FIG. 6. The steady-state temperature distribution for the case of two stages of secondary emission after the primary cathode. This is the temperature distribution in the first and second diamond emitter films due to electron beam bombardment and radiant heating from the primary cathode and secondary emitter films. The film is assumed to be at room temperature at its peripheral boundary.

FIG. 7. Schematic cross-section drawing of a robust Pierce gun (RPG). In this case, the primary cathode is of a thermionic type and is made of thoriated tungsten. Shown are two stages of secondary electron amplification. The dimensions are accurate for building an RPG.

FIG. 8. Schematic representation of the robust Pierce gun.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for producing electrons comprising the steps of:

moving along at least a first electron in a first direction from a first location;

striking a solid first area with the first electron where the first electron terminates; producing additional electrons moving along the first direction through a transmission mode at the first area due to the first electron striking the first area on the opposite side of the first area which was struck by the first electron;

moving along the additional electrons in the first direction from the first area to a solid second area;

striking the second area with the additional electrons; and creating more electrons moving along the first direction on the opposite side of the second area due to the additional electrons from the first area striking the second area.

2. An electron gun comprising:

an electrostatic cavity having a first stage with multiple electron emitting faces and multiple stages with solid electron emitting sections from which electrons are emitted in a first direction; and a mechanism for producing an electrostatic force that acts on the multiple electron emitting faces and the respective multiple electron emitting sections so electrons moving in a first direction from the respective multiple electron emitting faces and sections are directed in the first direction from the multiple electron emitting faces toward the respective multiple emitting sections to contact the respective solid multiple emitting sections and terminate in the respective emitting sections and generate additional electrons on the opposite side of the respective multiple emitting section in a transmission mode moving in the first direction and to further contact other emitting sections.

3. A gun as described in claim 2 wherein the multiple emitting sections include forward emitting surfaces.

4. A gun as described in claim 3 wherein the mechanism includes a mechanism for producing an electrostatic electric field that provides the electrostatic force and the electric field has a radial component that prevents the electrons from straying out of a region between the first stage with emitting faces and the multiple emitting sections, the field producing mechanism in electrical communication with the cavity.

5. A gun as described in claim 4 wherein the mechanism includes a mechanism for producing a flow of electrons from the first stage with emitting faces or from any emitting section to the end of the cavity, the flow producing mechanism in communication with the cavity.

6. A gun as described in claim 4 wherein the respective emitting sections accelerate electrons to a higher energy after they are created when the respective emitting sections are contacted by electrons.

7. A gun as described in claim 4 including a grid adjacent the cavity for bunching the electron.

8. A gun as described in claim 4 including a mechanism for producing a magnetic field to confine the electrons to contain the electrons anywhere from the first stage with emitting faces or any emitting section and the end of the cavity, the magnetic field producing mechanism in communication with the cavity.

* * * * *